US008976104B2

(12) United States Patent
Seo et al.

(10) Patent No.: US 8,976,104 B2
(45) Date of Patent: Mar. 10, 2015

(54) DISPLAY DEVICE AND DRIVING METHOD THEREOF

(75) Inventors: Young-Jun Seo, Seoul (KR); Byung-Choon Yang, Seoul (KR); Si-Joon Song, Suwon-si (KR); Dong-Min Yeo, Asan-si (KR)

(73) Assignee: Samsung Display Co., Ltd., Yogin, Gyeonggi-do (KR)

( * ) Notice: Subject to any disclaimer, the term of this patent is extended or adjusted under 35 U.S.C. 154(b) by 1058 days.

(21) Appl. No.: 12/772,531

(22) Filed: May 3, 2010

(65) Prior Publication Data

US 2011/0115828 A1 May 19, 2011

(30) Foreign Application Priority Data

Nov. 17, 2009 (KR) ..... 10-2009-0110605

(51) Int. Cl.
*G09G 3/36* (2006.01)
*G09G 3/34* (2006.01)

(52) U.S. Cl.
CPC ..... *G09G 3/342* (2013.01); *G09G 2320/0233* (2013.01); *G09G 2320/064* (2013.01); *G09G 2320/0646* (2013.01); *G09G 2360/16* (2013.01)
USPC ..... 345/102; 349/65

(58) Field of Classification Search
CPC ..... G02F 1/133615; G02F 1/133603; G02B 6/0068; G02B 6/0075; G02B 6/0078
USPC ..... 345/690, 102; 349/65
See application file for complete search history.

(56) References Cited

U.S. PATENT DOCUMENTS

| | | | | |
|---|---|---|---|---|
| 6,828,954 | B2 * | 12/2004 | Yoshihara et al. | 345/102 |
| 2007/0152926 | A1 * | 7/2007 | Kwon | 345/82 |
| 2007/0285379 | A1 * | 12/2007 | Jung et al. | 345/102 |
| 2008/0297467 | A1 | 12/2008 | Hsu et al. | |
| 2008/0316167 | A1 | 12/2008 | Kurokawa et al. | |
| 2009/0015755 | A1 * | 1/2009 | Bang et al. | 349/65 |
| 2010/0020005 | A1 * | 1/2010 | Jung et al. | 345/102 |
| 2010/0283802 | A1 * | 11/2010 | Jung et al. | 345/690 |

FOREIGN PATENT DOCUMENTS

| | | |
|---|---|---|
| JP | 2008-203292 | 9/2008 |
| JP | 2008-268642 | 11/2008 |

(Continued)

OTHER PUBLICATIONS

English Abstract for Publication No. 10-2009-0068591.
English Abstract for Publication No. 2008-203292.
English Abstract for Publication No. 2008-268642.

(Continued)

*Primary Examiner* — Quan-Zhen Wang
*Assistant Examiner* — Xuemei Zheng
(74) *Attorney, Agent, or Firm* — F. Chau & Associates, LLC

(57) ABSTRACT

A display device comprises a optical member, a plurality of light sources to illuminate the optical member, a representative determining part to determine representative values of image blocks based on image signals applied to the image blocks, wherein the image blocks are arranged in a matrix and correspond to portions of a display panel, a representative integration part to integrate the representative values of the image blocks in one of a row and a column direction of the matrix and determine integrated representative values, and a light control part to control the plurality of light sources based on the integrated representative values.

13 Claims, 4 Drawing Sheets

(56) References Cited

FOREIGN PATENT DOCUMENTS

| | | |
|---|---|---|
| KR | 10-2006-0076043 | 7/2006 |
| KR | 10-0758981 | 9/2007 |
| KR | 10-2008-0014221 | 2/2008 |
| KR | 10-2008-0016108 | 2/2008 |
| KR | 10-2009-0002730 | 1/2009 |
| KR | 10-2009-0003080 | 1/2009 |
| KR | 10-2009-0068591 | 6/2009 |
| KR | 10-2009-0071488 | 7/2009 |
| KR | 10-2009-0071913 | 7/2009 |

OTHER PUBLICATIONS

English Abstract for Publication No. 10-2007-0088148 (10-0758981).
English Abstract for Publication No. 10-2006-0076043.
English Abstract for Publication No. 10-2008-0014221.
English Abstract for Publication No. 10-2009-0071488.
English Abstract for Publication No. 10-2008-0016108.
English Abstract for Publication No. 10-2009-0002730.
English Abstract for Publication No. 10-2009-0003080.
English Abstract for Publication No. 10-2009-0071913.

* cited by examiner

DISPLAY DEVICE AND DRIVING METHOD THEREOF

CROSS-REFERENCE TO RELATED APPLICATION

This application claims priority to Korean Patent Application No. 10-2009-0110605, filed on Nov. 17, 2009, in the Korean Intellectual Property Office, which is herein incorporated by reference in its entirety.

BACKGROUND OF THE INVENTION

1. Technical Field

The present invention relates to a display device and driving method thereof, which improve image quality.

2. Discussion of Related Art

Generally, a liquid crystal display (LCD) comprises a liquid crystal panel and backlight assembly. The backlight assembly is positioned under the liquid crystal panel and provides light to the liquid crystal panel. The liquid crystal panel displays an image by adjusting the transmittance of the light provided from the backlight assembly.

The backlight assembly comprises a light source to generate light. The light source can be a cold cathode fluorescent lamp (CCFL), a fat fluorescent lamp (FFL), a light emitting diode (LED), etc.

The LED is made in a type of a chip and has a comparatively long life, fast turn-on time, and low electric consumption. For these reasons, the LED is increasingly adopted and used as the light source of the back light assembly.

The backlight assembly can be classified into an edge lit type and a direct lit type according to the position of the light source. The direct lit type backlight assembly has a plurality of light sources arranged under the liquid crystal panel, and the light sources directly illuminate the liquid crystal panel. The edge lit type backlight assembly has at least one light source arranged at the side of a light guide plate, and the light source indirectly illuminates the light crystal panel through the light guide plate.

SUMMARY OF THE INVENTION

An exemplary embodiment of the display device comprises a optical member, a plurality of light sources to illuminate the optical member, a representative determining part to determine representative values of image blocks based on image signals applied to the image blocks, wherein the image blocks are arranged in a matrix and correspond to portions of a display panel, a representative integration part to determine integrated representative values based on the representative values of the image blocks in one of a row and a column direction of the matrix, and a light control part to control the plurality of light sources based on the integrated representative values.

The display device may further comprise at least one of a prism or a lens sheet on the optical member. The display may further comprise a boundary compensation part to determine boundary representative values based on the integrated representative values of at least one neighboring image block.

The plurality of light sources may be arranged at a side or facing opposite sides of the optical member and may be light emitting diodes.

The integrated representative values may be determined by applying weight values to the representative values, wherein the weight values are relative values depending on an illumination distribution of the optical member and are represented as lower values at bright portions and higher values at the dark portions The representative values determined by the representative determining part may be representative image signals determined based on the image signals or representative light intensities determined after the image signals are converted into light intensities.

An exemplary embodiment of the driving method comprises determining representative values of image blocks based on image signals applied to the image blocks, wherein the image blocks are arranged in a matrix and correspond to portions of a display panel, determining integrated representative values based on the representative values of the image blocks in one of a row and a column direction of the matrix, and controlling a first plurality of light sources based on the integrated representative values, wherein the first plurality of light sources illuminate an optical member.

The plurality of light sources may be arranged at a side or facing opposite sides of the optical member and may be light emitting diodes.

The integrated representative values may be determined by applying weight values to the representative values, wherein the weight values are relative values depending on an illumination distribution of the optical member and are represented as lower values at bright portions and higher values at the dark portions The driving method further comprises determining boundary representative values based on the integrated representative values of at least one neighboring image block and controlling a second plurality of light sources based on the boundary representative values.

The driving method further comprises determining boundary representative values based on the integrated representative values of at least one neighboring image block and compensating the image signals corresponding to the integrated representative values and the boundary representative values.

The representative values determined by the representative determining part may be representative image signals determined based on the image signals or representative light intensities determined after the image signals are converted into light intensities.

BRIEF DESCRIPTION OF THE DRAWINGS

The accompanying drawings briefly described below illustrate exemplary embodiments of the present invention and, together with the description, serve to explain the principles of the present invention.

DETAILED DESCRIPTION OF EXEMPLARY EMBODIMENTS

The present invention will now be described more fully hereinafter with reference to the accompanying drawings, in which exemplary embodiments of the invention are shown.

According to an exemplary embodiment of the present invention, a local dimming driving method improves a contrast ratio of an image, by which the intensities of the light sources can be controlled based on image signals applied to the liquid crystal panel.

Figure 1:
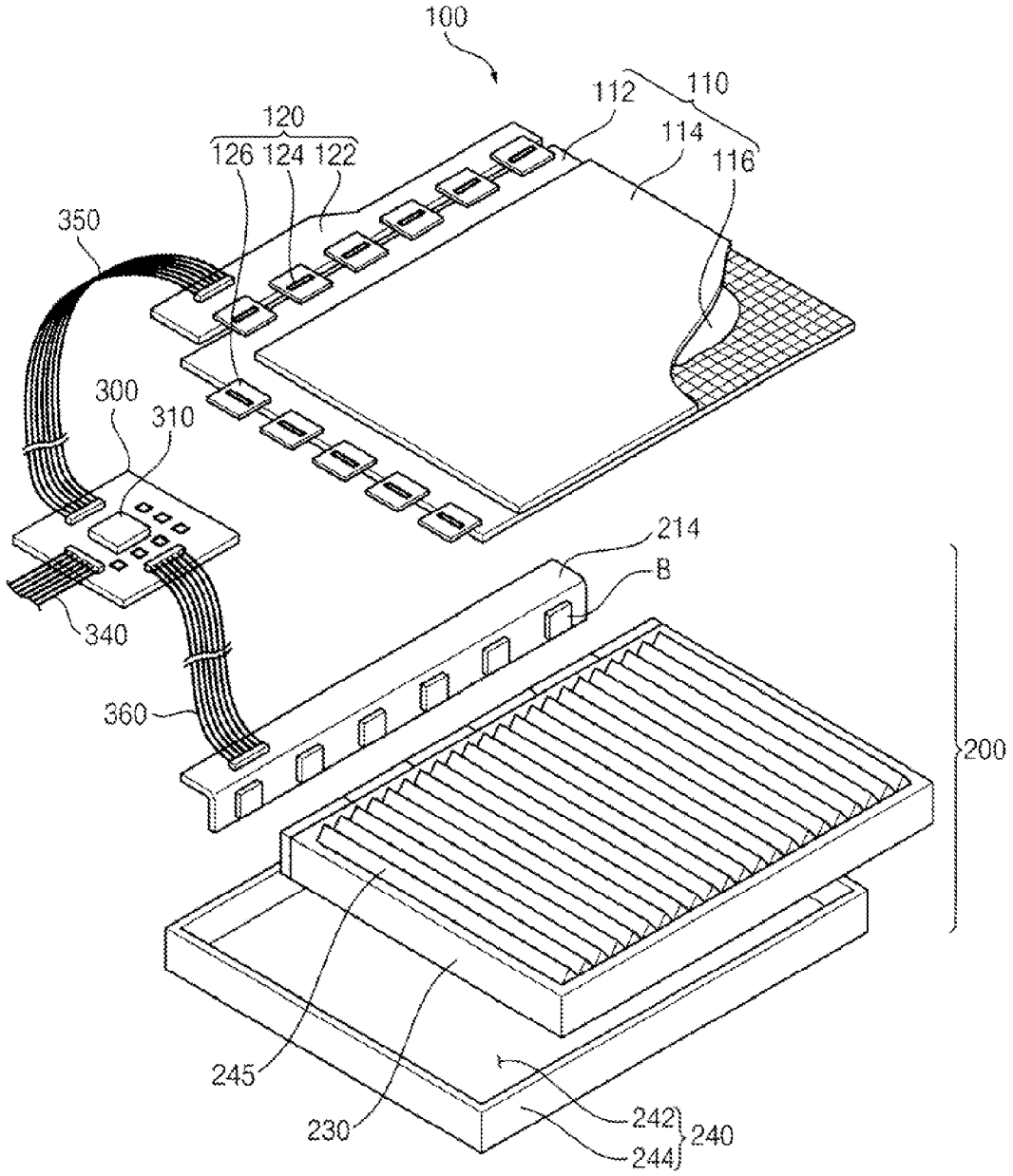
FIG. 1 is an exploded perspective of one embodiment of the display device.
Figure 2:
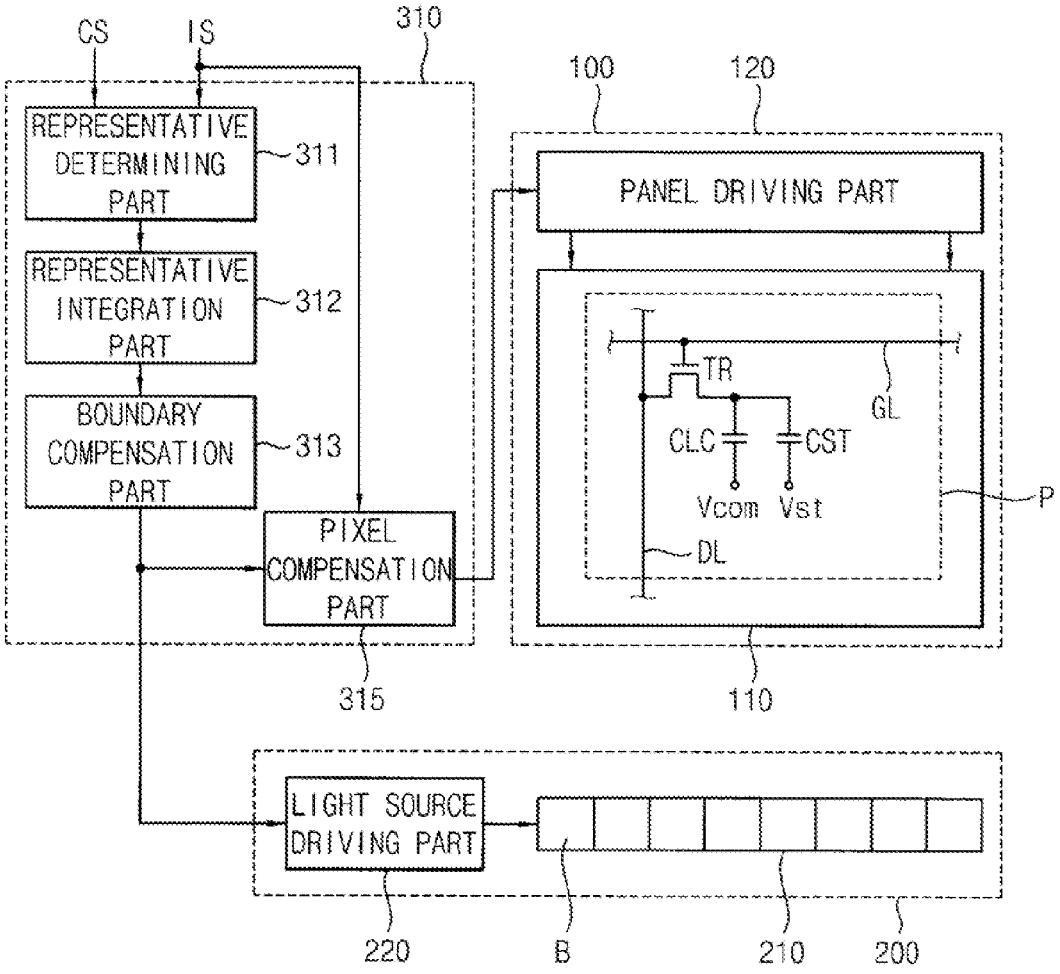
FIG. 2 is a block diagram to functionally describe the display device of FIG. 1.

FIG. 1 is an exploded perspective of an exemplary embodiment of the display device. FIG. 2 is a block diagram to functionally describe the display device of FIG. 1.

Referring to FIGS. 1 and 2, the display device comprises a display unit 100, a backlight assembly 200 and a controller board 300. The display unit 100 comprises a display panel 110 and a panel driving part 120.

The display panel 110 includes a first substrate 112, a second substrate 114 facing the first substrate, and a liquid crystal layer 116 interposed between the first and second substrates 112 and 114. The first substrate 112 may include a plurality of pixels to adjust a transmittance of light provided from the backlight assembly and display an image. Each pixel can include a switching element TR connected to a gate line GL and a data line DL. Each pixel can further include a liquid crystal capacitor CLC and a storage capacitor CST respectively connected to the switching element TR.

The panel driving part 120 includes a data printed circuit board 122, a data driving circuit film 124 connecting between the data printed circuit board 122 and the display panel 110, and a gate driving circuit film 126 connected to the display panel 110. The data driving circuit film 124 is connected to the data lines of the first substrate 112 and the gate driving circuit film 126 is connected to the gate lines of the first substrate 112. The data and gate driving circuit films 124 and 126 may comprise driving chips outputting driving signals to drive the display panel 110 in response to control signals supplied from the data printed circuit board 122.

The backlight assembly 200 may comprise a light source 210, a light source driving part 220, a light guide plate 230, a prism sheet 245, and a container 240. The backlight assembly 200 is disposed under the display panel 110 and provides the display panel 110 with light.

The backlight assembly 200 is an edge lit type that the plurality of light sources may be arranged at a side or facing opposite sides of the light guide plate 230.

The light source 210 may be a point light source, such as a light emitting diode (LED). The light source 210 is integrated on a driving board 214. The driving board 214 may include control lines (not shown) to control the light source 210 and power supply lines (not shown) to supply power to the light source 210. The light source 210 may be a white LED to emit white light or RGB LEDs to emit red, green or blue light, respectively.

The light source 210 can include a plurality of light emitting blocks B and each of light emitting blocks B includes at least one LED. Each LED may be controlled independently. The light emitting blocks B can provide image blocks of the display panel 110 with light independently of each other. By the independent control of the light emitting blocks B a local dimming may be achieved wherein the image blocks may display different light intensities independently even in a case where the display panel 110 receives the same image signals or display the same light intensities even in a case where the display panel 110 receives different image signals with respect to the image blocks.

The light source driving part 220 determines duty ratios of the light emitting blocks B using integrated representative values which correspond to the light emitting blocks B and are output from the controller board 300. The light source driving part 220 generates driving signals of light sources based on the duty ratios. The light source driving part 220 provides the light emitting blocks B with the driving signals of light sources and controls the light emitting blocks B, respectively.

A light guide plate 230 is an optical member which guides light emitted from the light sources 210. The light sources 210 are arranged at a side or sides of the optical member to a bottom surface of the display panel 110. A prism sheet 245 is an optical member which refracts and collimates light emitted from the light guide plate 230.

The container 240 can accommodate the display panel 100, the light sources 210, the light guide plate 230 and so on. The container 240 includes a bottom plate 242 and side plates 244 connected to the bottom plate 242.

One or more additional optical sheets (not shown) can be further inserted between the display panel 110 and the light guide plate 230 as an optical member in order to promote light characteristics. For example, an exemplary optical sheets can a diffuse sheet to promote light uniformity.

The controller board 300 is electrically connected to the display panel 100 and the backlight assembly 200 and controls the display panel 100 and the backlight assembly 200. The controller board 300 includes a controller unit 310, a first connector 340, a second connector 350 and a third connector 360.

The first connector 340 is connected to an external device (not shown). The first connector 340 carriers image signals IS and control signals CS to the controller unit 310. The image signals IS and control signals CS are transmitted from the external device. The second connector 350 is electrically connected to the display panel 100 and carries the image signals IS to the display panel 100. The third connector 360 is electrically connected to the light source driving part 220 of the backlight assembly 200.

The controller unit 310 comprises a representative determining part 311, a representative integration part 312, a boundary compensation part 313 and a pixel compensation part 315.

The representative determining part 311 determines representative values of image blocks based on image signals IS applied to image blocks, wherein the image blocks corresponding to portions of a display panel 100 are arranged in a matrix. The representative values may be representative image signals determined based on the image signals corresponding to the image blocks or representative light intensities determined after the image signals are converted into light intensities.

The representative integration part 312 integrates the representative values of the image blocks in row or column directions of the matrix and determines integrated representative values. The integrated representative values may be determined by applying weight values to the representative values, wherein the weight values are relative values depending on an illumination distribution of the optical member and are represented as lower values at bright portions and higher values at the dark portions.

The boundary compensation part 313 determines boundary representative values based on the integrated representative values of at least one neighboring image block. The boundary compensation part 313 provides the pixel compensation part 315 with the boundary representative values and transmits the integrated representative values to the light source driving part 220.

The pixel compensation part 315 compensates the image signals IS corresponding to the integrated representative values and the boundary representative values. For example, when an entire image displayed darkens by backlight dimming, the image signals IS to display a bright figure can be compensated to offset the effect of the backlight dimming so that the bright figure is displayed with substantially the same light intensity, regardless of the backlight dimming. In addition, the image signals IS corresponding to the boundary representative values can be compensated to reduce differences in light intensities caused by the light emitting blocks that are driven based on the integrated representative values.

Figure 3:
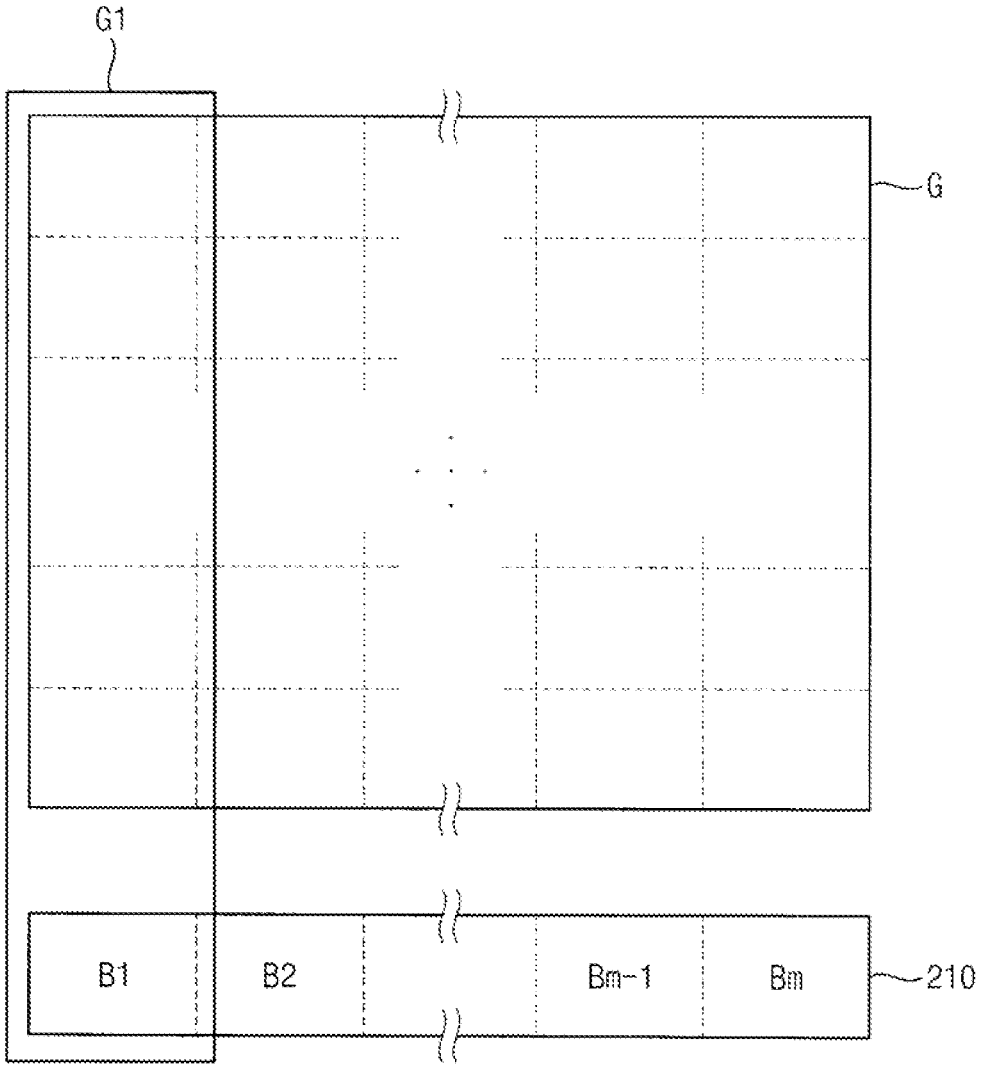
FIG. 3 and FIG. 4 are image blocks arranged in a matrix and light emitting blocks arranged at a side thereof.
Figure 4:
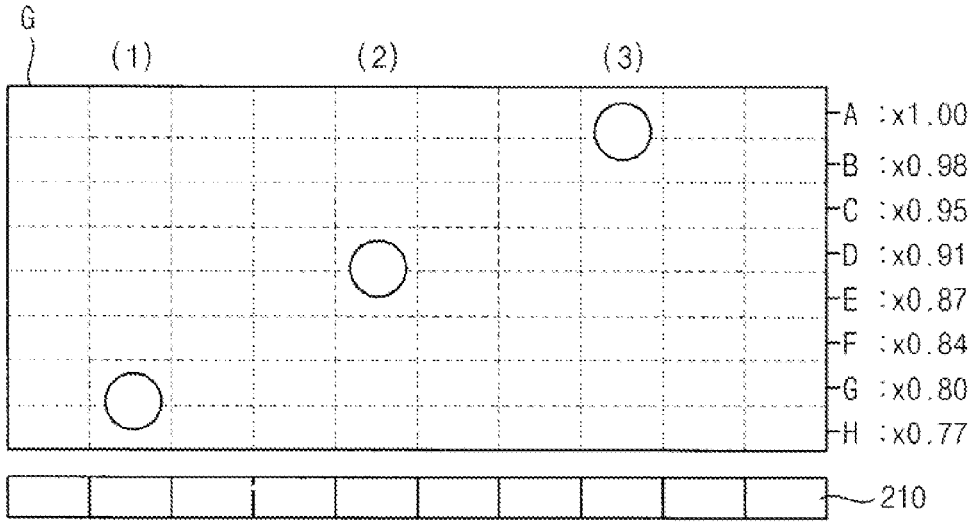

FIG. 3 and FIG. 4 show image blocks arranged in a matrix and light emitting blocks arranged at a side thereof.

Image blocks G are conceptual portions of the display panel 110, arranged in a 2-dimension matrix. The image blocks G have weight values according to an illumination distribution in the image blocks G. The illumination distribution in the image blocks G corresponds to the arrangement of the light emitting blocks B. The weight values may be relatively small values at the image blocks G close to the light source 210 and relatively big values at the image blocks G far from the light source 210. If the light sources are arranged at a side of the optical member, the image blocks close to the side of the optical member have relatively small weight values and the image blocks far from the side have relatively large weight values. If the light sources are arranged at facing opposite sides of the optical member, the image blocks close to the sides of the optical member have relatively small weight values and the image blocks of center portions far from the sides have relatively large weight values.

An illumination intensity distribution of the image blocks G can be varied according to the types or arrangement of an optical member(s). Thus, the Weight values are determined through the actual estimation of illumination intensity distribution.

For example, a first integrate representative value corresponding to a first light emitting block B1 can be determined by the weighted average of the representative values of the image blocks G1 arranged corresponding to the first light emitting block B1. Second to m-th integrate representative values corresponding to second to m-th light emitting blocks B2 to Bm can be similarly determined by the weighted average.

Referring to FIG. 4, when three circle figures having the same image signal are displayed at different rows among columns (1), (2) and (3) of the image blocks G, the light emitting blocks would be driven in the same illumination if the integrated representative values were not determined by applying weight values to the representative values of the image blocks G having the three circle figures. However the edge lit type backlight assembly 200 can have a non-uniform illumination distribution at different locations of a light output so that images having different illuminations can be displayed even if the same image signals are applied to a liquid crystal display.

To make an illumination distribution substantially uniform when the same image signals are applied to a liquid crystal display, the light emitting blocks of the backlight assembly 200 can be operated to illuminate different light intensities, based on the weight values and the representative values of the image blocks G.

For example, in FIG. 4, the weight values are assigned to the rows A-H of the image blocks G. Image blocks corresponding to a first circle figure of the column (1) are assigned the weight values of 0.77~0.88, image blocks corresponding to a second circle figure of the column (2) are assigned in 0.87~0.91 and image blocks corresponding to a third circle figure of the column (3) are assigned in 0.98~1. Thus, although the applied image signals are the same in corresponding image blocks, the integrated representative values can be determined as different values in an order of (3)>(2)>(1).

Figure 5:
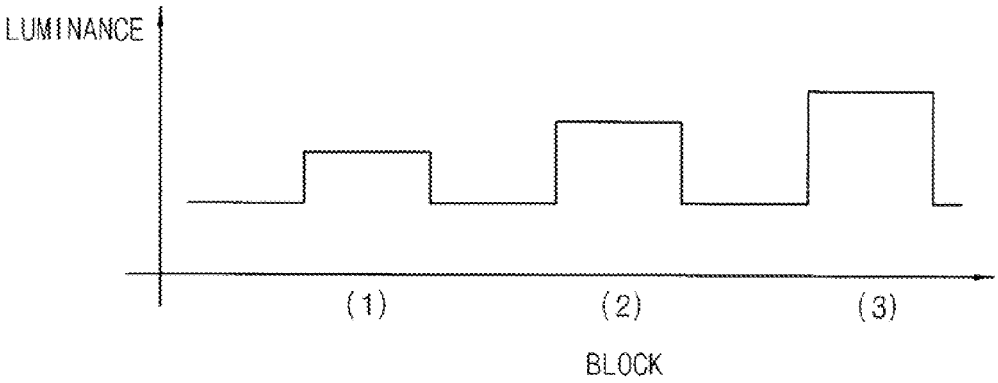
FIG. 5 is a conceptual graph to represent luminance of the light emitting blocks in order to display an image of FIG. 4.

FIG. 5 is a conceptual graph to represent luminance of the light emitting blocks in order to display an image of FIG. 4.

After the integrated representative values are determined, the light emitting blocks are driven to illuminate different light intensities as shown in FIG. 5 by the weight values corresponding to image blocks, respectively.

According to exemplary embodiments of the present invention, the light emitting blocks can be driven independently based on an illumination distribution of the backlight assembly and image signals.

What is claimed is:

1. A display device comprising an optical member;

a plurality of light sources facing a side surface of the optical member in a first direction and arranged in a second direction perpendicular to the first direction to illuminate the optical member;

a representative determining part to determine representative values of image blocks based on image signals applied to the image blocks, wherein the image blocks are arranged in a matrix and correspond to portions of a display panel;

a representative integration part to integrate the representative values of the image blocks for each of image block groups respectively corresponding to the plurality of light sources in the first direction and determine integrated representative values thr the image block groups, respectively;

a light control part to control the plurality of light sources respectively based on the integrated representative values, wherein the integrated representative values are determined by applying weight values to the representative values, and a weight value for a first image block is larger than a weight value for a second image block closer to the light sources than the first image block is; and a boundary compensation part to determine boundary representative values based on the integrated representative values of at least one neighboring image block.

2. The display device of the claim 1, wherein the plurality of light sources is arranged at one side of the optical member.

3. The display device of the claim 2, further comprising at least one of a prism and a lens sheet on the optical member.

4. The display device of the claim 1, wherein the plurality of light sources is arranged at two opposite sides of the optical member.

5. The display device of the claim 1, wherein the representative values are representative image signals determined based on the image signals.

6. The display device of the claim 1, wherein the representative values are representative light intensities determined after the image signals are converted into light intensities.

7. A driving method of a display device, the display device including an optical member and a plurality of light sources facing a side surface of the optical member in a first direction and arranged in a second direction perpendicular to the first direction, the driving method comprising:

determining representative values of image blocks based on image signals applied to the image blocks, wherein the image blocks are arranged in a matrix and correspond to portions of a display panel;

integrating the representative values of the images blocks for each of a plurality of image block groups respectively corresponding to the plurality of light sources in the first direction to determine integrated representative values for the image block groups, respectively, controlling the plurality of light sources respectively based on the integrated representative values, wherein the integrated representative values are determined by applying weight values to the representative values, and a weight value for a first image block is larger than a weight value for a second image block closer to the light sources than the first image block is; and determining boundary representative values based on the integrated representative values of at least one neighboring image block.

8. The driving method of the display device of claim 7, wherein the plurality of light sources is arranged at one side of the optical member.

9. The driving method of the display device of claim 7, wherein the plurality of light sources is arranged at two opposite sides of the optical member.

10. The driving method of the display device of claim 7, further comprising controlling a second plurality of light sources based on the boundary representative values.

11. The driving method of the display device of claim 7, further comprising:

compensating the image signals corresponding to the integrated representative values and the boundary representative values.

12. The driving method of the display device of claim 7, wherein the representative values are representative image signals determined based on the image signals.

13. The driving method of the display device of claim 7, wherein the representative values are representative light intensities determined after the image signals are converted into light intensities.

* * * * *